US006519438B2

(12) United States Patent
Munemori et al.

(10) Patent No.: US 6,519,438 B2
(45) Date of Patent: Feb. 11, 2003

(54) TANDEM TYPE COLOR IMAGE FORMING APPARATUS HAVING AN INTERMEDIATE TRANSFER BELT

(75) Inventors: Seiichi Munemori, Toyokawa (JP); Takanobu Yamada, Toyokawa (JP); Yuusuke Morikami, Toyohashi (JP)

(73) Assignee: Minolta Co., Ltd., Osaka (JP)

( * ) Notice: Subject to any disclaimer, the term of this patent is extended or adjusted under 35 U.S.C. 154(b) by 22 days.

(21) Appl. No.: 09/879,196

(22) Filed: Jun. 13, 2001

(65) Prior Publication Data

US 2002/0001488 A1 Jan. 3, 2002

(30) Foreign Application Priority Data

Jun. 30, 2000 (JP) ..... 2000/198501

(51) Int. Cl.[7] ..... G03G 15/01
(52) U.S. Cl. ..... 399/298; 399/299; 399/302
(58) Field of Search ..... 399/298, 299, 399/300, 301, 302, 308

(56) References Cited

U.S. PATENT DOCUMENTS 5,287,160 A 2/1994 Dastin et al. ..... 399/301
5,802,422 A 9/1998 Hokari ..... 399/36
5,946,525 A 8/1999 Okamura et al. ..... 399/66
6,029,033 A 2/2000 Kawasaki ..... 399/149
6,049,350 A 4/2000 Yamaguchi ..... 347/241
6,061,542 A 5/2000 Minami et al. ..... 399/299
6,335,747 B1 * 1/2002 Munakata ..... 399/301 X
6,353,721 B1 * 3/2002 Yamaguchi et al. .... 399/302 X

FOREIGN PATENT DOCUMENTS

JP 07-028294 9/1993

* cited by examiner

*Primary Examiner*—Hoan Tran
(74) *Attorney, Agent, or Firm*—Morrison & Foerster LLP

(57) ABSTRACT

A color image forming apparatus in accordance with the present invention including an intermediate transfer member having a movable surface. The apparatus also includes plural image forming units for forming toner images on the intermediate transfer member at each of image-forming positions, and a transfer roller for transferring the toner images formed on the intermediate transfer member onto a sheet, the transfer roller having a circumferential length equal to the distance between the adjacent image forming positions.

20 Claims, 3 Drawing Sheets

TANDEM TYPE COLOR IMAGE FORMING APPARATUS HAVING AN INTERMEDIATE TRANSFER BELT

RELATED APPLICATIONS

The present invention is based on Japanese Patent Applications No. 2000-198501, each content of which being incorporated by reference.

BACKGROUND OF THE INVENTION

1. Field of the Invention

The present invention relates to a so-called tandem-type color image forming apparatus.

2. Description of the Related Art

A so-called tandem-type color image forming apparatus is conventionally known in which a plurality of image forming units storing toners of different colors are arranged along an intermediate transfer belt, as disclosed in Japanese laid-open Patent Application No. HEI 7-28294.

With such an image forming apparatus, images of respective colors are formed, one upon another, on the intermediate transfer belt in respective image forming units, and the resulting composite color image is transferred from the transfer belt onto a sheet due to a voltage applied to a transfer roller.

However, when the transfer roller is eccentric relative to its rotation shaft, it causes fluctuation in a rotation speed of the intermediate transfer belt. As a result, color deviation may occur when the image forming units superimpose images of respective colors one upon another on the intermediate transfer belt.

SUMMARY OF THE INVENTION

It is, therefore, an object of the present invention to provide an image forming apparatus which is capable of preventing color deviation of an image even when a transfer roller is eccentric.

A color image forming apparatus in accordance with the present invention comprises: an intermediate transfer member having a movable surface; a plural image forming units for forming toner images on the intermediate transfer member at each of image-forming positions; and a transfer roller for transferring the toner images formed on the intermediate transfer member onto a sheet, the transfer roller having a circumferential length equal to the distance between adjacent image forming positions.

In the image forming apparatus according to the present invention, the circumferential length of the transfer roller is made equal to the distance between adjacent image forming positions. Therefore, even when the transfer roller is eccentric and hence the rotation speed of the intermediate transfer member fluctuates, the rotation speed of the intermediate transfer member is the same at the times when respective image forming means form respective color images at a point of the intermediate transfer member. As a result, it is possible to form an image on the intermediate transfer member without causing color deviation.

DESCRIPTION OF THE PREFERRED EMBODIMENTS

A Preferred embodiment of the present invention will be described below with reference to the accompanying drawings.

Figure 1:
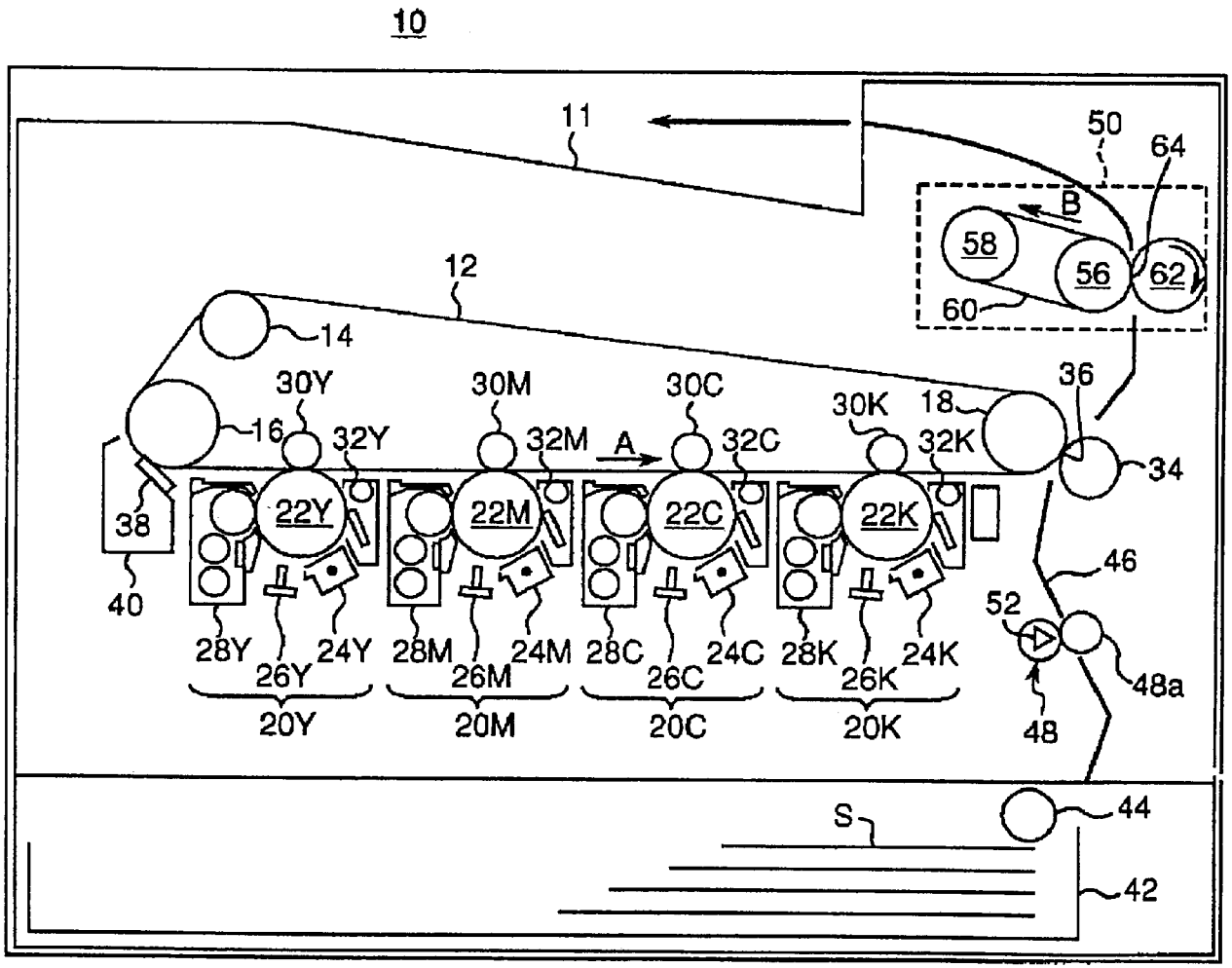
FIG. 1 illustrates the whole structure of a printer embodying the present invention.

FIG. 1 illustrates the whole structure of a tandem-type digital color printer 10 (hereinafter simply referred to as a printer) embodying the present invention.

The printer 10 includes an intermediate transfer belt 12 provided at a generally central portion thereof. The intermediate transfer belt 12 is carried by outer circumferential portions of three rollers 14, 16 and 18 to be driven for rotation in the direction indicated by an arrow A.

Four image forming units 20Y, 20M, 20C and 20K for respectively forming a toner image of the corresponding color of yellow (Y), magenta (M), cyan (C) and black (K) are arranged below and along a lower horizontal portion of the intermediate transfer belt 12 close to each other at a predetermined pitch P. The image forming units 20Y, 20M, 20C and 20K include photosensitive drums 22Y, 22M, 22C and 22K, respectively. Around the photosensitive drum 22Y and along its rotational direction, there are provided, a charging device 24Y for uniformly charging a surface of the photosensitive drum 22Y, a printhead section 26Y for exposing the uniformly charged surface of the photosensitive drum to light in accordance with image data to form an electrostatic latent image, a developer 28Y for developing the electrostatic latent image formed on the surface of the photosensitive drum with yellow toners to form a toner image, a primary transfer roller 30Y disposed in facing relationship to the photosensitive drum 22Y via the intermediate transfer belt 12 for electrostatically attracting the toner image formed on the photosensitive drum to primarily transfer the image onto the intermediate transfer belt 12, and a cleaner 32Y for cleaning the photosensitive drum by removing toners remaining on the surface of the photosensitive drum after the primary transfer. Similarly, around the photosensitive drum 22M and along its rotational direction, there are provided a charging device 24M, a printhead section 26M, a developer 28M for developing the electrostatic latent image formed on the surface of the photosensitive drum with magenta toners to form a toner image, a primary transfer roller 30M and a cleaner 32M. Around the photosensitive drum 22C, there are provided a charging device 24C, a printhead section 26C, a developer 28C for developing the electrostatic latent image formed on the surface of the photosensitive drum with cyan toners to form a toner image, a primary transfer roller 30C and a cleaner 32C. Similarly, around the photosensitive drum 22K, there are provided a charging device 24K, a printhead section 26K, a developer 28K for developing the electrostatic latent image formed on the surface of the photosensitive drum with black toners to form a toner image, a primary transfer roller 30K and a cleaner 32K. Each of the printhead section 26Y, 26M, 26C, and 26K comprises a multiplicity of LEDs aligned in a primary scanning direction extending in parallel with the axis of the photosensitive drum.

There is also provided a secondary transfer roller 34 which is pressed against a portion of the intermediate transfer belt 12 carried by the roller 18. The secondary transfer roller 34 has a circumferential length which is equal to the pitch P (See FIG. 2) at which the image forming units 20Y, 20M, 20C, and 20K are arranged. The pitch P is a distance between adjacent image forming potions of adjacent image forming units. A nip portion defined between the secondary transfer roller 34 and the intermediate transfer belt 12 serves as a secondary transfer region 36. A high voltage for image transfer is applied across the secondary transfer roller 34. Due to this voltage, toner images formed on the intermediate transfer belt 12 are electrostatically attracted onto a sheet as a recording medium transported to the secondary transfer region 36 for secondary transfer, which will be described later.

A cleaner 38 is pressed against a portion of the intermediate transfer belt 12 carried by the roller 16. The cleaner 38 is provided for scraping off the toners remaining on the intermediate transfer belt 12 after the secondary transfer and collecting the toners in a waste toner box 40.

A sheet cassette 42 is removably disposed at a lower portion of the printer 10. Sheets S stacked in the sheet cassette 42 are fed, one by one from the topmost sheet, to a transport path 46 by the rotation of a sheet feeding roller 44.

The transport path 46 extends from the sheet cassette 42 through a nip portion between a pair of timing rollers 48, the secondary transfer region 36 and a fixing unit 50 to a discharged sheet tray 11.

A sheet-feed sensor 52 is disposed adjacent the pair of timing rollers 48. The sheet-feed sensor 52 is provided to detect that the leading edge of a sheet S fed from the sheet cassette 42 to the transport path 46 is nipped in the paired timing rollers 48. When the sheet-feed sensor 52 detects the leading edge of a sheet S, the paired timing rollers 48 once stop the rotation, and thereafter, in synchronism with toner images on the intermediate transfer belt 12, transport the sheet S to the secondary transfer region 36.

The fixing unit 50 includes a pair of rollers 56, 58, a fixing belt 60 carried around the rollers 56, 58 for rotation in the direction indicated by an arrow B, and a fixing roller 62 pressed against the roller 56 via the fixing belt 60 to be driven for rotation in an arrow direction. A nip portion defined between the fixing belt 60 and the fixing roller 62 through which the sheet bearing the secondarily transferred toner images passes serves as a fixing region 64.

To be described next is the operation of the printer 10 having the above-described structure.

When image signals are input from an external device (a personal computer for example) to an image signal processing unit (not shown) in the printer 10, the image signal processing unit converts the signals to digital image signals for respective colors of yellow, cyan, magenta and black, and transmits the signals to a printhead LED drive circuit. Based on thus input digital signals, the drive circuit drives the printhead sections 26Y, 26M, 26C and 26K of the image forming unit 20Y, 20M, 20C and 20K to emit light for performing light exposure. The light exposure operation is performed sequentially at respective printhead sections 26Y, 26M, 26C and 26K at predetermined time intervals. As a result, electrostatic latent images for respective colors are formed on the surfaces of the photosensitive drums 22Y, 22M, 22C and 22K.

The electrostatic latent images respectively formed on the photosensitive drums 22Y, 22M, 22C and 22K are developed by the developer 28Y, 28M, 28C and 28K into toner images for respective colors. Then, by the operation of the primary transfer rollers 30Y, 30M, 30C and 30K, the toner images for respective colors are primarily transferred, with one superimposed upon another, onto the intermediate transfer belt 12 moving in the direction of the arrow A.

Figure 2:
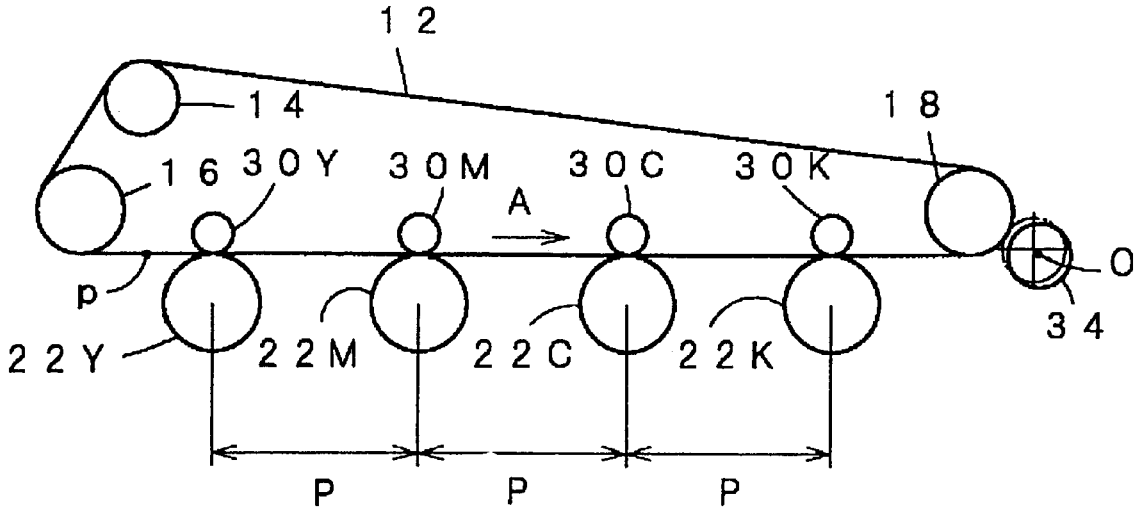
FIG. 2 is a schematic view showing a portion adjacent the intermediate transfer belt of FIG. 1.
Figure 3A:
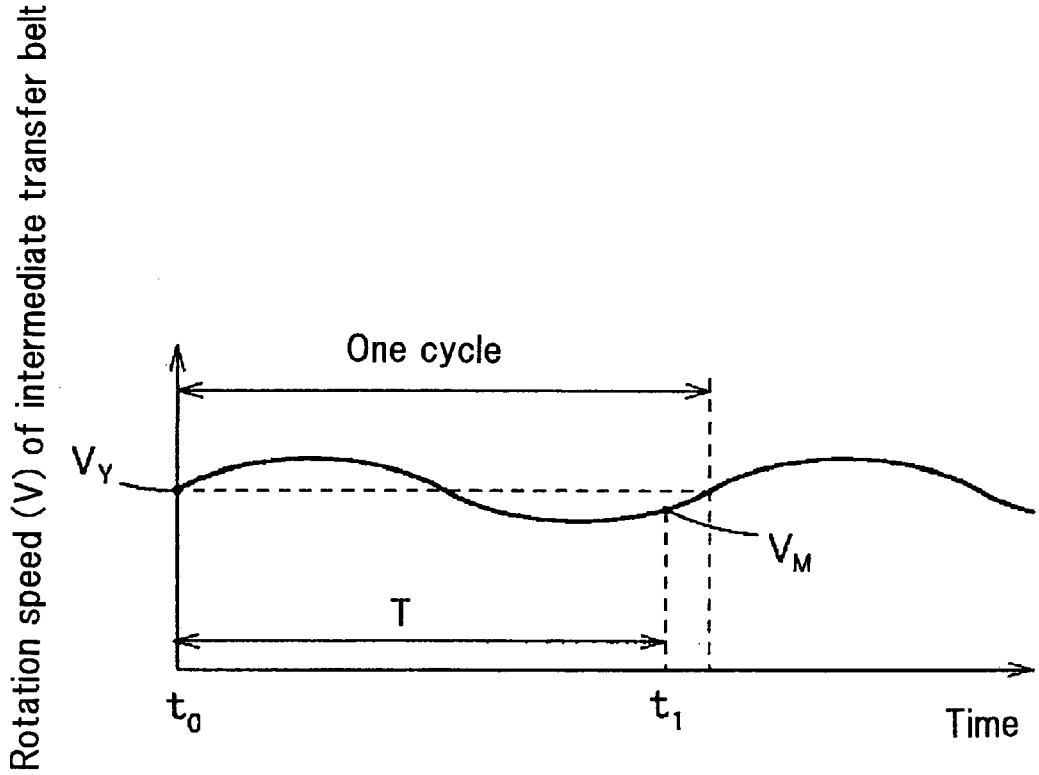
FIG. 3(*a*) and FIG. 3(*b*) are graphs showing fluctuation of rotation speed of the intermediate transfer belt.
Figure 3B:
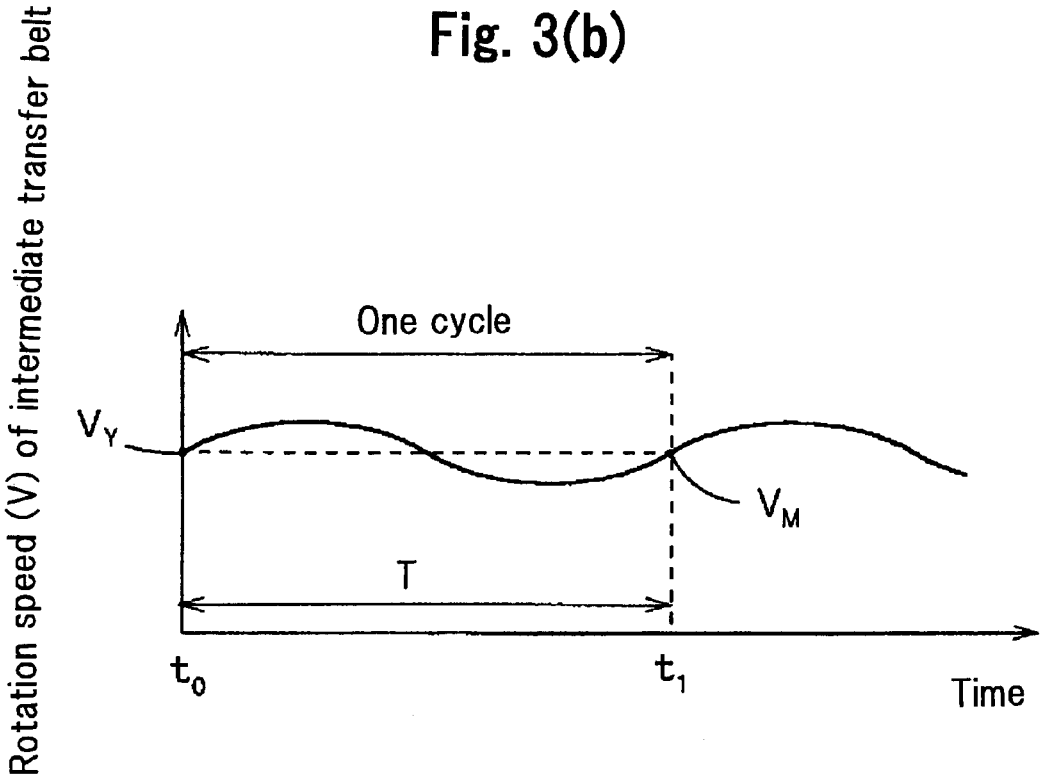

At this time, when the center O of the secondary transfer roller 34 is eccentric, the rotation speed of the intermediate transfer belt, which receives load from the secondary transfer roller 34, fluctuates with a fluctuation cycle corresponding to the time for one revolution of the secondary transfer roller 34, as shown in FIG. 2. If the circumferential length of the secondary transfer roller 34 is different from the pitch P, or longer than the pitch P for example, the cycle of speed fluctuation becomes longer than the period of time T from the time to when the image forming unit 20Y transfers an image Y at a point p (shown in FIG. 2) of the intermediate transfer belt 12 to the time $t_1$ when the image forming unit 20M transfer an image M so as to superimpose on the image Y, as shown in FIG. 3(*a*). Therefore, the rotation speed $V_M$ of the intermediate transfer belt 12 at the time of the transferring of the image M becomes different from the rotation speed $V_Y$ of the intermediate transfer belt 12 at the time of the transferring of the image Y, which results in color deviation of the images transferred onto the intermediate transfer belt 12. However, when the circumferential length of the secondary transfer roller 34 is equal to the pitch P, the fluctuation cycle of rotation speed of the intermediate transfer belt 12 coincides with the period of time T, as shown in FIG. 3(*b*). Therefore, precisely when one cycle has passed, i.e., at time $t_1$, the image forming unit 20M transfers the image M. At this time, the rotation speed $V_M$ of the intermediate transfer belt 12 at the time of the transferring of the image M is the same as the rotation speed $V_Y$ of the intermediate transfer belt 12 at the time of the transferring of the image Y. Therefore, color deviation does not occur.

Since the circumferential length of the intermediate transfer roller 34 is equal to the pitch P in this embodiment, the rotation speed fluctuation occurs similarly at each pitch between adjacent ones of the image forming units 20Y, 20M, 20C and 20K, as described before. As a result, the rotation speed of the intermediate transfer belt is the same at the times when the image forming units 20Y, 20M, 20C and 20K primarily transfer the respective color images on the intermediate transfer belt 12 in a superimposed manner. Therefore, color deviation does not occur and imperfect image forming results can be avoided.

Referring again to FIG. 1, after the primary image transfer is performed, toners of respective colors remaining on the surfaces of the photosensitive drums are scraped off by cleaner blades 33Y, 33M, 33C and 33K of the cleaner 32Y, 32M, 32C and 32K and collected in the bodies of the cleaners. The superimposed, or composite color toner image thus formed on the intermediate transfer belt 12 moves in accordance with the movement of the intermediate transfer belt 12 to reach the secondary transfer region 36. At the secondary transfer region 36, the composite color toner image is secondarily transferred, by the operation of the secondary transfer roller 34, onto a sheet S which is fed from the sheet cassette 42 and transported along the transport path 46 through the pair of timing rollers 48. It is to be noted that toners remaining on the intermediate transfer belt 12 after the secondary transfer are collected by the cleaner 38.

The sheet S on which the toner image is secondarily transferred is advanced along the transport path 46 to the fixing unit 50 and passes through the fixing region 64 provided therein. As a result, the toner image is fixed on the sheet S. Then, the sheet S is discharged to the discharged sheet tray 11.

In this embodiment, since the image forming units 20Y, 20M, 20C and 20K are disposed on a lower side of the intermediate transfer belt, it is possible to shorten the distance between the primary transfer position of the image forming unit 20K and the secondary transfer position. This brings about the advantage that the image forming on a first one sheet can be performed speedily. Further, when the image forming operation is interrupted due to a paper jam for example, toner images formed on the intermediate transfer belt are reduced so that the amount of toners to be wasted can be reduced. Furthermore, the distance between the secondary transfer region and the fixing unit can be easily shortened so that the apparatus is applicable for the image forming on a smaller-sized paper such as a postcard.

Further, although a belt is used in this embodiment, an intermediate transfer member having another configuration such as a drum may be employed for the present invention.

Furthermore, although the image forming units are arranged on the lower side of the intermediate transfer belt in this embodiment, the image forming units may be arranged on the upper side of the intermediate transfer belt.

Moreover, although a printer is exemplarily described in this embodiment, the present invention may be applicable to other image forming apparatus such a copying machine, a facsimile machine, or a multi function apparatus including these and a printer.

Although the present invention has been fully described by way of examples, it is to be noted that various changes and modification will be apparent to those skilled in the art.

Therefore, unless otherwise such changes and modifications depart form the scope of the present invention, they should be construed as being included therein.

What is claimed is:

1. A color image forming apparatus comprising:

an intermediate transfer belt having a movable surface;

a first image forming unit for forming a first toner image of a first color on the intermediate transfer belt at a first image-forming position;

a second image forming unit for forming a second toner image of a second color to superimpose on the first toner image formed on the intermediate transfer belt at a second image-forming position, the second image forming unit being disposed downstream of the first image forming unit with respect to a moving direction of the intermediate transfer belt, the second image-forming position being spaced from the first image-forming position by a predetermined distance P;

a third image forming unit for forming a third toner image of a third color to superimpose on the first and the second toner images formed on the intermediate transfer belt at a third image-forming position, the third image forming unit being disposed downstream of the second image forming unit with respect to the moving direction of the intermediate transfer belt, the third image-forming position being spaced from the second image-forming position by the distance P;

a fourth image forming unit for forming a fourth toner image of a fourth color to superimpose on the first, the second and the third toner images formed on the intermediate transfer belt at a fourth image-forming position, the fourth image forming unit being disposed downstream of the third image forming unit with respect to the moving direction of the intermediate transfer belt, the fourth image-forming position being spaced from the third image-forming position by the distance P; and a transfer roller for transferring the superimposed toner images formed on the intermediate transfer belt onto a sheet, the transfer roller having a circumferential length equal to the distance P.

2. The color image forming apparatus of claim 1, wherein the first image forming unit, the second image forming unit, the third image forming unit and the fourth image forming unit are disposed on a lower side of the intermediate transfer belt.

3. The color image forming apparatus of claim 2, wherein the intermediate transfer belt is carried by a plural rollers including a first roller and a second roller, the first roller being pressed against the transfer roller via the intermediate transfer belt, the second roller being located at the opposite side of the first roller and contacted with a cleaner via the intermediate transfer belt.

4. The color image forming apparatus of claim 3, wherein the plural rollers includes the first roller, the second roller and a third roller which is located downstream of the first roller with respect to the moving direction of the intermediate transfer belt and is located upstream of the second roller with respect to the moving direction of the intermediate transfer belt.

5. The color image forming apparatus of claim 3, wherein the first image forming unit, the second image forming unit, the third image forming unit and the fourth image forming unit are disposed on a lower side of the intermediate transfer belt between the first roller and the second roller, the first through the fourth image forming units being located downstream of the second roller with respect to the moving direction of the intermediate transfer belt and located upstream of the first roller with respect to the moving direction of the intermediate transfer belt.

6. The color image forming apparatus of claim 3, comprising a sheet feeding device including a sheet storing portion and a sheet feeding roller for feeding sheets stored in the sheet storing portion, the sheet feeding device being disposed on a lower side of the first through the fourth image forming units.

7. The color image forming apparatus of claim 6, comprising a pair of timing rollers for feeding a sheet fed from the sheet feeding device to a nip portion between the transfer roller and the first roller in synchronism with the superimposed toner images on the intermediate transfer belt, the pair of timing rollers being disposed on a lower side of the nip portion between the transfer roller and the first roller.

8. The color image forming apparatus of claim 7, comprising a fixing unit for fixing the superimposed toner images transferred on the sheet by the transfer roller, the fixing unit being disposed on an upper side of the nip portion between the transfer roller and the first roller.

9. The color image forming apparatus of claim 8, comprising a discharged sheet tray for discharging the sheet on which the superimposed toner images are fixed by the fixing unit, the discharged sheet tray being disposed on an upper side of the intermediate transfer belt.

10. The color image forming apparatus of claim 2, wherein the fourth image forming unit forms a black toner image.

11. A color image forming apparatus, comprising:

an intermediate transfer member having a movable surface;

a plurality of image forming units for forming toner images on the intermediate transfer member at each of image-forming positions; and a transfer roller for transferring the toner images formed on the intermediate transfer member onto a sheet, the transfer roller having a circumferential length equal to the distance between adjacent image forming positions.

12. The color image forming apparatus of claim 11, wherein the intermediate transfer member is an intermediate transfer belt, the plural image forming units being disposed on a lower side of the intermediate transfer belt.

13. The color image forming apparatus of claim 12, wherein the intermediate transfer belt is carried by a plural rollers including a first roller and a second roller, the first roller being pressed against the transfer roller via the intermediate transfer belt, the second roller being located at the opposite side of the first roller and contacted with a cleaner via the intermediate transfer belt.

14. The color image forming apparatus of claim 13, wherein the plural rollers includes the first roller, the second roller and a third roller which is located downstream of the first roller with respect to a moving direction of the intermediate transfer belt and is located upstream of the second roller with respect to the moving direction of the intermediate transfer belt.

15. The color image forming apparatus of claim 13, wherein the plural image forming units are disposed on a lower side of the intermediate transfer belt between the first roller and the second roller, the plural image forming units being located downstream of the second roller with respect to the moving direction of the intermediate transfer belt and located upstream of the first roller with respect to the moving direction of the intermediate transfer belt.

16. The color image forming apparatus of claim 13, comprising a sheet feeding device including a sheet storing portion and a sheet feeding roller for feeding sheets stored in the sheet storing portion, the sheet feeding device being disposed on a lower side of the plurality of image forming units.

17. The color image forming apparatus of claim 16, comprising a pair of timing rollers for feeding a sheet fed from the sheet feeding device to a nip portion between the transfer roller and the first roller in synchronism with the toner images on the intermediate transfer belt, the pair of timing rollers being disposed on a lower side of the nip portion between the transfer roller and the first roller.

18. The color image forming apparatus of claim 17, comprising a fixing unit for fixing the toner images transferred on the sheet by the transfer roller, the fixing unit being disposed on an upper side of the nip portion between the transfer roller and the first roller.

19. The color image forming apparatus of claim 18, comprising a discharged sheet tray for discharging the sheet on which the toner images are fixed by the fixing unit, the discharged sheet tray being disposed on an upper side of the intermediate transfer belt.

20. The color image forming apparatus of claim 12, wherein the image forming unit located most-downstream in the plural image forming units with respect to the moving direction of the intermediate transfer belt forms a black toner image.

* * * * *

UNITED STATES PATENT AND TRADEMARK OFFICE

CERTIFICATE OF CORRECTION

PATENT NO. : 6,519,438 B1 
DATED : February 11, 2003
INVENTOR(S) : Seiichi Munemori et al.

It is certified that error appears in the above-identified patent and that said Letters Patent is hereby corrected as shown below:

Column 6,
Line 5, please change “plural” to -- plurality of --.

Column 7,
Line 2, please change “plural” to -- plurality of --.

Signed and Sealed this

Twenty-sixth Day of August, 2003

JAMES E. ROGAN
*Director of the United States Patent and Trademark Office*